United States Patent [19]

Welch

[11] 4,337,833

[45] Jul. 6, 1982

[54] TILTABLE BOX SCRAPER FOR THREE-POINT ATTACHMENT TO A TRACTOR

[76] Inventor: Rafael J. Welch, P.O. Box 175, St. John, Kans. 67576

[21] Appl. No.: 213,995

[22] Filed: Dec. 8, 1980

[51] Int. Cl.[3] ..... E02F 3/76

[52] U.S. Cl. ..... 172/445.1; 172/459

[58] Field of Search ..... 172/799.5, 445.1, 445.2, 172/684.5, 787, 316, 459, 224, 460, 225, 666, 679, 743, 448, 449, 779, 780; 37/118 R, 124, 126 R

[56] References Cited

U.S. PATENT DOCUMENTS

| | | | |
|---|---|---|---|
| 1,928,778 | 10/1933 | Austin | 172/799.5 |
| 2,493,565 | 1/1950 | Arps | 172/445.2 |
| 2,723,472 | 11/1955 | Bartlett | 172/445.1 |
| 3,302,317 | 2/1967 | Domres | 172/799.5 |
| 3,515,221 | 6/1970 | Fowler | 172/445.2 |
| 3,598,186 | 8/1971 | Coontz | 172/445.2 |
| 3,858,663 | 1/1975 | Lurwig | 172/445.2 |
| 4,061,194 | 12/1977 | McCanse | 172/445.2 |
| 4,082,150 | 4/1978 | Winkles | 172/799.5 |
| 4,189,009 | 2/1980 | Welch | 172/384 |

FOREIGN PATENT DOCUMENTS

| | | | |
|---|---|---|---|
| 137087 | of 1950 | Australia | 172/445.2 |

*Primary Examiner*—Richard J. Johnson

*Attorney, Agent, or Firm*—Edwin H. Crabtree

[57] ABSTRACT

An improved tiltable box scraper for attachment to a standard three-point hitch at the rear of a farm tractor or the like. The box scraper characterized by having a single hydraulic cylinder mounted thereon for tilting the scraper in opposite directions independently of the position of the tractor on the ground surface.

3 Claims, 3 Drawing Figures

TILTABLE BOX SCRAPER FOR THREE-POINT ATTACHMENT TO A TRACTOR

BACKGROUND OF THE INVENTION

This invention relates to a scraper for attachment to the rear of a farm tractor, construction equipment and various earth moving equipment and more particularly, but not by way of limitation to a box scraper which can be tilted independently of the position of the pulling vehicle.

Heretofore, there have been various types of earth moving equipment having scrapers mounted thereon such as the equipment disclosed in U.S. Pat. No. 4,189,009 to the subject inventor, U.S. Pat. No. 3,515,221 to Fowler, U.S. Pat. No. 3,858,663 to Lurwig, Jr., U.S. Pat. No. 3,598,186 to Coontz, U.S. Pat. No. 3,820,609 to Trott, U.S. Pat. No. 3,302,317 to Domres, and U.S. Pat. No. 4,061,194 to McCense. All of the above mentioned patents disclose different types of earth moving equipment but none of them specifically disclose the unique features and advantages of the invention described herein.

SUMMARY OF THE INVENTION

The subject improved tiltable box scraper can be tilted in opposite lateral directions from the direction the scraper is being pulled. Only a single hydraulic cylinder is required to tilt the scraper.

The scraper is tilted independently of the position of the pulling vehicle on the ground surface. The invention is rugged in construction, simple in design and is readily adaptable to various types of farm tractors, construction equipment, and earth moving equipment having a standard three-point hitch attached to the rear of the vehicle.

The improved tiltable box scraper for attaching to a standard three-point hitch at the rear of a farm tractor or the like includes a scraper housing having a moldboard with a cutting blade attached at an angle to the bottom of the moldboard and a pair of vertical end plates attached to the opposite ends of the moldboard. A lateral support brace is attached at opposite ends to the front of the end plates. A pipe sleeve is attached to and centered on the support brace with the other end attached to and centered on the top of the moldboard. A rectangular shaped housing support having a horizontal lower pivot bar and a horizontal upper bar attached to a first vertical bar and a second vertical bar supports the scraper housing with the pivot bar slidably received through the pipe sleeve. A hydraulic cylinder is attached to the lateral support bar and the upper bar of the housing support for pivoting the housing on the pivot bar. Connecting arms with pins are attached to a first vertical arm for securing the scraper to the three-point hitch.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
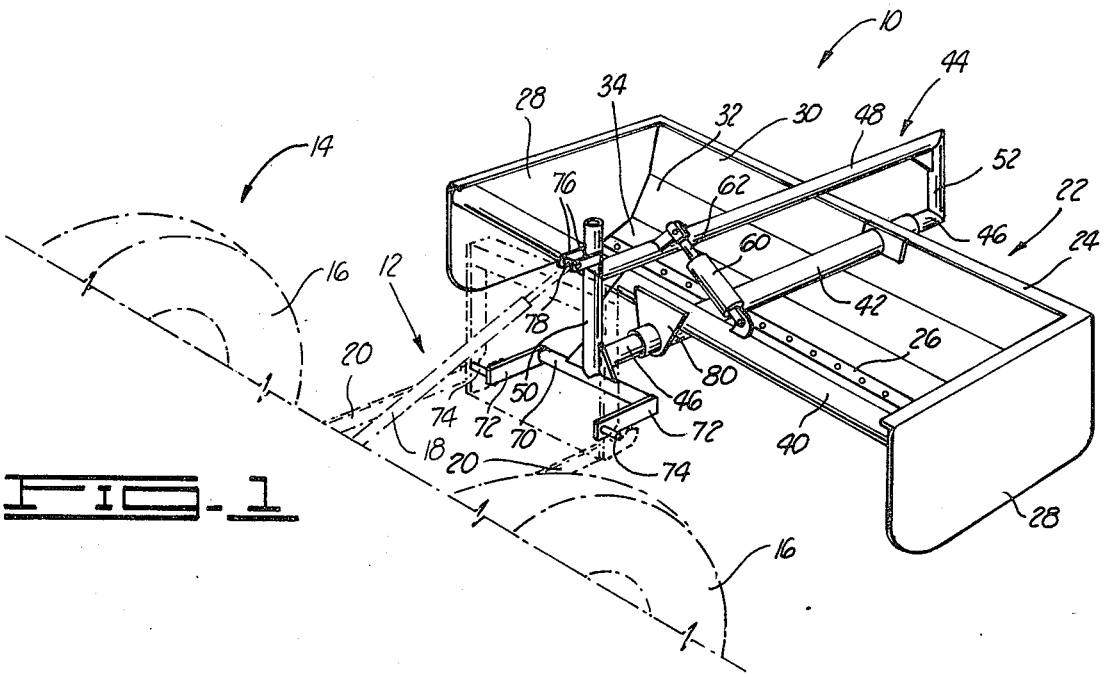
In FIG. 1 a perspective view of the improved tiltable box scraper is shown attached to a standard three-point hitch at the rear of a farm tractor.

In FIG. 1, the improved tiltable box scraper is shown in a perspective view and designated by general reference numeral 10. The scraper 10 is releasably attached to a three-point hitch 12 which is often standard equipment at the rear of a tractor 14 having rear wheels 16 which are shown in dotted lines in FIGS. 1 and 2. The standard three-point hitch 12 includes an adjustment arm 18 and a pair of attachment arms 20.

The scraper 10 includes a scraper housing 22 having a moldboard 24 with a cutting blade 26 attached at an angle to the bottom of the moldboard 24. The housing 22 further includes a pair of end plates 28 secured to the opposite ends of the moldboard 24. It should be noted that the moldboard 24 is divided into three elongated portions 30, 32 and 34, all integrally attached to each other and at angles to each other. The lower portion 34 is attached to the cutting blade 26. By dividing the moldboard 24 into the elongated sections 30, 32 and 34 it has been found the scraper works more efficiently in engages and cuts into a ground surface with the pressure on the moldboard 24 relieved against the ground cut by distributing the earth as it is lifted into the housing 22 at different angles comprised by the three portions 30, 32 and 34.

A lateral support brace 40 is attached at opposite ends to the front of the end plates 28. A pipe sleeve 42 has one end attached to and centered on the support brace 40. The other end of the sleeve 42 is attached to and centered on the moldboard 24.

A rectangular shaped housing support 44 supports the housing 22 on the tractor 16 and above the ground surface. The housing support 44 includes a horizontal lower pivot bar 46, a horizontal upper bar 48, a first vertical bar 50 and a second vertical bar 52. The first bar 50 and second bar 52 are attached to the opposite ends of the horizontal bars 46 and 48. The pivot bar 46 is slidably received through the pipe sleeve 42.

A hydraulic cylinder 60 is attached at one end to the support brace 40 with a hydraulic ram 62 of the cylinder 60 attached to the horizontal upper bar 48. The hydraulic lines while not shown in the drawings can be driven by the hydraulic system of the tractor 14.

Attached to the first vertical bar 50 of the housing support 44 is a cross arm 70 having a pair of connecting arms 72 with pins 74 for releasably engaging the attachment arms 20 of the hitch 12. Attached to the top of the vertical bar 50 are a pair of connecting arms 76 having a pin 78 for attaching to the adjustment arm 18.

Figure 2:
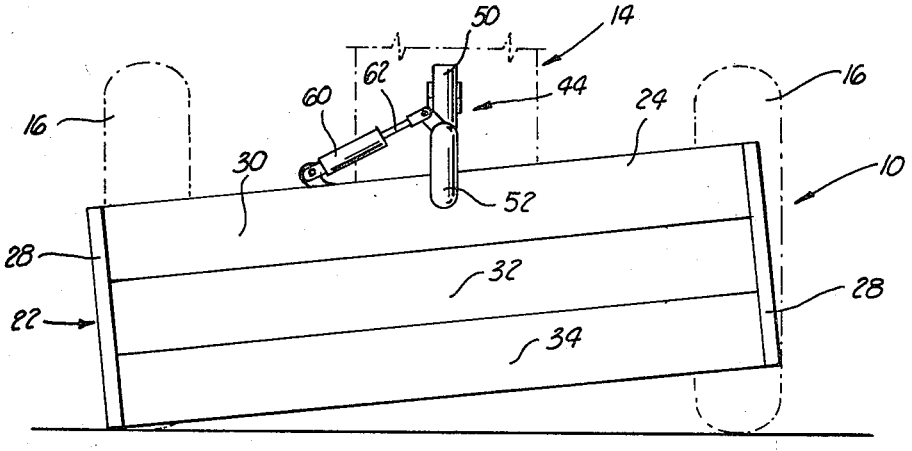
FIG. 2 is a rear view of the box scraper tilted to the left independently of the position of the farm tractor on the ground surface.

In FIG. 2 a rear view of the scraper 10 is illustrated with the scraper housing 22 tilted to the left for engaging the ground surface. It should again be noted that by actuating the single hydraulic cylinder 60, the scraper housing 22 can be tilted either to the left or to the right independently of the position of the tractor wheels 16 on the ground surface. Further, through the rugged design of the rectangular shaped housing support 44, the scraper housing need not have a wheeled axle for supporting the housing 22 on the ground surface.

Figure 3:
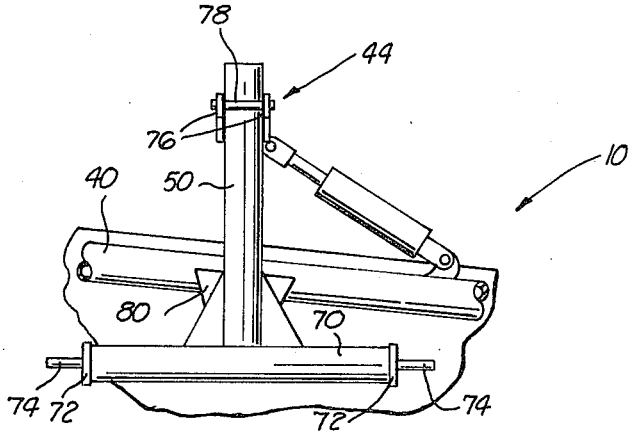
FIG. 3 is an enlarged front view of a portion of the scraper used for attaching to the three-point hitch.

In FIG. 3 an enlarged partial view of the support brace 40 and the first vertical bar 50 are shown. In this view, the scraper 10 has been removed from the rear of the tractor 14 and the connecting pins 74 and 78 have in turn been removed from the connecting arms 20 and the adjustment arm 18 of the three-point hitch. While the pipe sleeve 42 cannot be seen in FIG. 3, an angular shaped plate 80 can be seen which is used for securing the lateral support brace 40 to the sleeve 42. It should be noted that by removing the pin 78 from the connecting arms 76 and the pins 74 from the connecting arms 20, the scraper 10 can quickly be removed from the rear of the tractor 14 until it is desired to again use the improved tiltable box scraper 10.

Changes may be made in the construction and arrangement of the parts or elements of the embodiments as described herein without departing from the spirit or scope of the invention defined in the following claims.

What is claimed is:

1. An improved tiltable box scraper for attaching to a standard three-point hitch at the rear of a farm tractor or the like, the scraper comprising:

a scraper housing having a moldboard with a cutting blade attached at an angle to the bottom of the moldboard and a pair of vertical end plates, the opposite ends of the moldboard attached to the rear of the end plates;

a lateral support brace, parallel to the moldboard, the opposite ends of the support brace attached to the front of end plates;

a pipe sleeve, one end of the sleeve attached to and centered on the support brace, the other end attached to and centered on the moldboard;

a rectangular shaped housing support, the support having a horizontal lower pivot bar, a horizontal upper bar, a first vertical bar attached to one end of the upper bar and one end of the pivot bar and a second vertical bar attached to the other end of the upper bar and the other end of the pivot bar, the pivot bar slidably received through the pipe sleeve;

pivot means attached at one end to the support brace and the other end attached to the upper bar for pivoting the housing on the pivot bar; and attachment means secured to the first vertical bar for releasably attaching the scraper to the three-point hitch.

2. An improved tiltable box scraper for attaching to a standard three-point hitch at the rear of a farm tractor or the like, the scraper comprising:

a scraper housing having a moldboard with a cutting blade attached at an angle to the bottom of the moldboard and a pair of vertical end plates, the opposite ends of the moldboard attached to the rear of the end plates;

a lateral support brace, parallel to the moldboard, the opposite ends of the support brace attached to the front of the end plates;

a pipe sleeve, one end of the sleeve attached to and centered on the support brace, the other end attached to and centered on the moldboard;

a housing support having a lower pivot bar, an upper bar, a first upright bar attached at one end to the upper bar and having a second portion attached to the pivot bar, and a second upright bar attached to the other end of the upper bar and the pivot bar, the pivot bar slidably received through the pipe sleeve;

pivot means attached at one end to the support brace and the other end attached to the upper bar for pivoting the housing on the pivot bar; and attachment means secured to the first upright bar for releasably attaching the scraper to the three-point hitch.

3. The scraper as described in claim 2 wherein the pivot means is a hydraulic cylinder, one end of the cylinder attached to the support brace, the cylinder hydraulic ram attached to the housing support.

* * * * *